US008409688B2

(12) United States Patent
Afolabi

(10) Patent No.: US 8,409,688 B2
(45) Date of Patent: Apr. 2, 2013

(54) WATER DRAINING FOOT MAT

(76) Inventor: Oluwafemi Ajibola Afolabi, Mississauga (CA)

( * ) Notice: Subject to any disclaimer, the term of this patent is extended or adjusted under 35 U.S.C. 154(b) by 486 days.

(21) Appl. No.: 12/695,178

(22) Filed: Jan. 28, 2010

(65) Prior Publication Data

US 2011/0183102 A1 Jul. 28, 2011

(51) Int. Cl.
*B32B 3/26* (2006.01)
*E01C 11/24* (2006.01)

(52) U.S. Cl. ..... 428/119; 4/251.1; 52/177; 404/32; 404/25; 428/81; 428/83; 428/88; 428/120; 428/121

(58) Field of Classification Search ..... D6/583, D6/585, 586, 587, 592; D32/14.1, 47; D12/203; 4/251.1, 251.2; 280/163, 164.1, 164.2, 291; 119/450, 525, 526, 527, 528, 529, 530; 52/177, 52/302.1, 302.3; 404/32, 35; 15/215, 216, 15/217, 236.01, 237, 238; 296/97.23, 75; 428/81, 83, 88, 119, 120, 121, 122, 130, 428/131, 132, 133, 134, 135, 136, 137, 138, 428/139, 140, 141, 156, 157, 159, 163, 167, 428/212, 220, 221

See application file for complete search history.

(56) References Cited

U.S. PATENT DOCUMENTS

| | | | | |
|---|---|---|---|---|
| 3,206,785 | A * | 9/1965 | Heil | 15/215 |
| D346,256 | S * | 4/1994 | Thomas et al. | D34/32 |
| 5,868,270 | A * | 2/1999 | Sandaj et al. | 220/571 |
| 6,202,689 | B1 | 3/2001 | Williams | |
| 6,589,631 | B1 * | 7/2003 | Suzuki et al. | 428/172 |
| 2002/0092110 | A1 | 7/2002 | Blum et al. | |
| 2003/0066253 | A1 * | 4/2003 | Lin | 52/177 |
| 2005/0055937 | A1 * | 3/2005 | Zimmerle et al. | 52/506.01 |

* cited by examiner

*Primary Examiner* — Brent O'Hern

(57) ABSTRACT

A water draining foot mat having a base with a plurality of upward extending projections where the upper draining surface of the base is sloped to facilitate the draining of water from the mat and the tops of the projections form a support for people to step on. The projections are sufficiently spaced apart to permit the majority of snow impinging the mat to contact the base where it can melt with the assistance of sunlight or salt so that the resulting water flows off the mat. The mat optionally includes water retaining walls with one or more water exits so that the walls in conjunction with the slope of the upper surface of the base cause water impinging on the mat to flow towards the water exits and off the mat.

14 Claims, 3 Drawing Sheets

WATER DRAINING FOOT MAT

FIELD OF THE INVENTION

The present invention relates generally to foot mats, and more particularly to foot mats for outdoor use that facilitate the removal of water from the surface of the mat.

BACKGROUND OF THE INVENTION

Foot mats, which may be referred to as doormats and stair treads, are often used in households and workplaces to protect flooring or stepping surfaces from residues being transported under footwear. These mats often possess characteristics suited to remove particles from footwear and to provide a cushioning effect to a person's step.

Mats that are intended to be used outdoors should be able to function adequately in the presence of rain and snow. Typically snow will accumulate on a mat and make it difficult to use, and water may accumulate on a mat. Some mats incorporate heating elements that convert electricity to heat for the purpose of melting snow that falls on the mat. However, this requires an electricity source, paying for the electricity, and adds to the cost of the mat.

Some mats have been disclosed with projections connected to the surface of a base for the purpose of allowing water to accumulate on the base while keeping the feet of people contacting the mat out of the water. These mats have been designed for use in automobiles and generally employ projections with a total cross-sectional area that is large relative to the total area of the mat, and generally provide for no way of draining water from the mat other than by evaporation or by lifting the mat. Such mats would not function well in outdoor conditions where they are exposed to rain and snow, as the snow and water would accumulate on the mat.

SUMMARY OF THE INVENTION

The invention relates to a foot mat for resting on a floor comprising a. a base having a sloping draining surface for draining water, and b. a plurality of substantially regularly spaced projections connected to the base for supporting the weight of a person who steps on the mat, wherein the total cross-sectional area of the projections is no more than one quarter of the total area of the draining surface.

The total cross-sectional area of the projections may be no more than one eighth of the total area of the draining surface.

The top ends of the projections may be substantially in a plane parallel to the floor. At least four projections may fall at least partially within any circle inscribed on the draining surface having a diameter of three inches. The projections may be cylindrical and each have approximately the same width which is at least one eighth of an inch and not more than one inch. Each projection may be separated from the nearest other projection by a distance of at least twice the diameter of the projections and not more than eight times the diameter of the projections, where the distance between projections is the distance between the central vertical axes of the projections.

The base may further comprise a water retaining wall extending partially around the edges of the base and have a water exit to permit water to run off the mat through the water exit.

The base may be substantially rectangular and have a front edge, a back edge, a left edge, and a right edge. The front edge may be higher than the back edge and the draining surface may be sloped to cause water to run off the back edge. The base may further comprise a water retaining wall extending partially around the edges of the base and have a water exit to permit water to run off the mat through the water exit. The water exit may be a gap in the water retaining wall on the front edge. The width of the water exit may be no less than five percent of the width of the front edge and no more than twenty-five percent of the width of the front edge.

The base may further comprise first and second water exits and wherein the draining surface is sloped to cause water impinging on a portion of the draining surface to run towards the first water exit and to cause water impinging on the other portions of the draining surface to run towards the second water exit.

The draining surface may comprise particle retainers for slowing removal of particles on the draining surface. A particle retainer may be a depression in the draining surface.

BRIEF DESCRIPTION OF THE DRAWINGS

The present invention will now be described by way of example with reference to the following drawings.

DETAILED DESCRIPTION OF THE INVENTION

Figure 1:
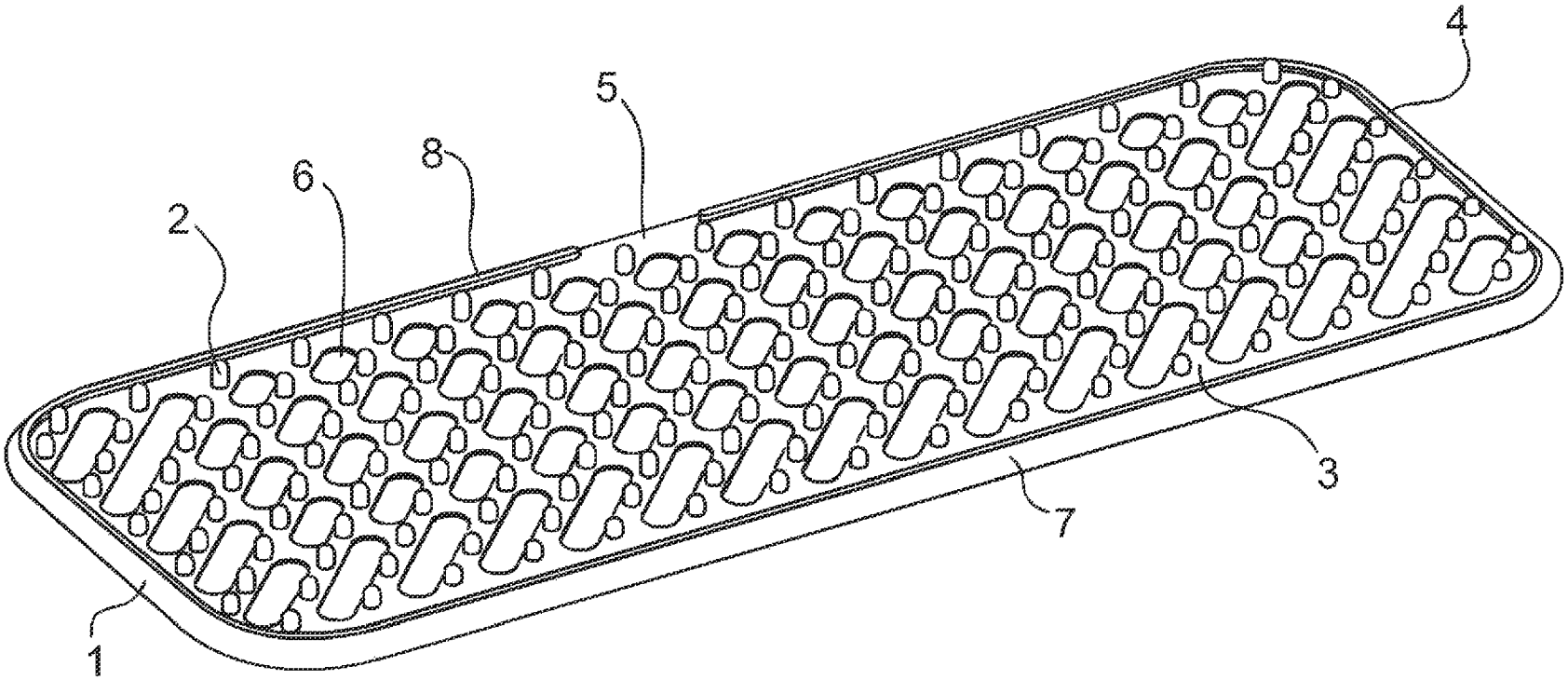
FIG. 1 is a perspective view of one embodiment of the invention showing the upper side.

In a preferred embodiment shown in FIG. 1, the foot mat includes a base 1 with a number of projections 2 connected to the base 1. The base 1 and projections 2 may be integrally formed from the same substrate or may be elements that are formed separately and subsequently attached, for example using an adhesive or thermobonding process.

The base 1 is generally formed in a substantially rectangular shape with the corners rounded as shown in FIG. 1, although other shapes are possible. If the base 1 is substantially rectangular, one edge may be designated the front edge 7 and the opposite edge the back edge 8, with the other two edges being referred to as the left and right edges.

The base 1 and projections 2 may be made of the same material, which could be a thermoplastic material such as thermoplastic polyurethanes of the polyether or polyester type or aliphatic polyurethane, or alternatively they may be made of a woven or non-woven fabric formed of synthetic or natural materials.

The foot mat is used by placing it on a substantially level surface, or floor, such as the surface of a porch outside the exterior door of a house, with the projections 2 on the upper side and the underside of the base 1 resting on the floor, where the base is adapted to lie in a substantially flat position on the floor.

The upper surface of the base 1, to which the projections 2 are attached, is the draining surface 3. The draining surface 3 is designed so that water may flow across it. The draining surface 3 is designed so that, for any given point on the draining surface 3, the surface is formed so that water that is placed on that point will flow to one of the edges of the mat under the force of gravity when the mat is resting on a floor. For example, the draining surface 3 may be in a single plane which is higher at the front edge 7 than the back edge 8 so that water placed at any point on the draining surface 3 will flow to approximately the closest point on the back edge 8. Alternatively, for example, the draining surface 3 may have its highest point near the center of the base 1 such that the height of the base 1 above the floor monotonically decreases from that central point to each point on the edges.

In the preferred configuration shown in FIG. 1, the mat has a water retaining wall 4 which rises above the draining surface 3 along some parts of the edges of the base 1. The water retaining wall 4 shown in FIG. 1 extends around all edges of the base 1 except for a relatively small portion, which is referred to as a water exit 5. The width of a water exit 5 may be, for example, 5 to 25% of the length of one edge of the base 1. Alternatively it could extend along the entire extent of one edge. The base 1 is designed so that water placed at any point on the draining surface 3 will flow to a water exit 5. For example, if the draining surface 3 is in a single plane that is higher at the front edge 7 than at the back edge 8, then a water exit 5 may be positioned on the back edge 8 of the base 1. Alternatively multiple water exits 5 may be employed, such as one at each end of the back edge 8.

The water retaining wall 4 is designed to guide water that flows to an edge of the base 1 towards a water exit 5 under the force of gravity when the mat is resting on a floor. The slope of the draining surface 3 may be designed to direct water impinging on one portion of the draining surface 3 to one water exit and water impinging on other portions of the draining surface 3 to flow towards a different water exit 5. For example, the draining surface 3 may be highest near its center along a line extending from the front to the back edge and slope down towards both the right and left edges, with a water exit being located in each of the right and left edges. In that case, water impinging on a portion of the draining surface 3 nearer to the left or right edge respectively will flow towards that edge.

Figure 3:
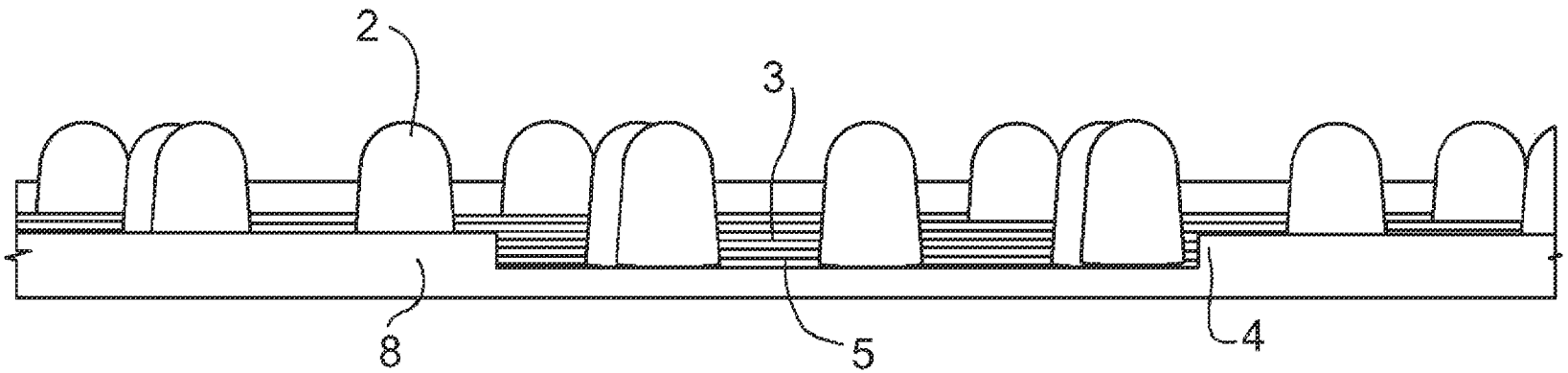
FIG. 3 is a partial view of the back edge of one embodiment of the invention.

A water exit 5 on the back edge 8 of the base 1 can be seen more clearly in FIG. 3, which shows a partial view of the front edge 8 including a water exit 5 in the middle corresponding to the water exit 5 shown in FIG. 1. The water exit 5 in this embodiment is a gap in the water retaining wall 4. In other embodiments, a portion of the draining surface 3 in the neighbourhood of the water exit 5 could be designed to have a lower height above the floor with an increased slope to further facilitate the drainage of water.

It is not essential that the draining surface 3 be smoothly sloping as long as the height is substantially monotonically non-increasing from each point on the draining surface 3 to an edge, or to a water exit 5 if a water retaining wall 4 is used. For example, the draining surface 3 could be stepped so that multiple steps form the slope that allows water to drain.

In a preferred embodiment, the height of each projection 2, which is the distance that the highest point on each projection 2 extends above the draining surface 3, may be designed so that the highest points of all projections 2 within any circle approximately three inches in diameter are all located approximately in a plane so that they can simultaneously engage with a flat surface, such as the sole of a shoe, that is placed on top of them. In the preferred embodiment shown in FIG. 1, the highest points of all the projections 2 are approximately in a single plane that is approximately parallel to the floor when the mat is resting on a floor. As seen in FIG. 1, the heights of the projections 2 decrease as the projections are further away from the front edge 7 in proportion to their distance from the front edge 7 since the front edge 7 is higher than the back edge 8 and the draining surface 3 is planar. The height of a projection may vary, for example, from as small as one eighth of an inch to as much as one and a half inches.

The material or materials used to construct the mat and minimum size and number of the projections 1 are selected so that any group of projections in any circle approximately three inches in diameter can support the weight of a person without causing the highest points of those projections to deviate substantially from being in a plane, so that a person can step on the mat while walking without significantly disrupting the person's movement. This requires a sufficient number of sufficiently large projections to be located within any given area.

For example, a typical configuration as exemplified by FIG. 1 would have the projections attached in a grid configuration where each projection is cylindrical, with a vertical axis substantially perpendicular to the floor or to the draining surface 3. The width of a projection 2 is the maximum width of any cross section through the projection 2 taken parallel to the floor when the mat is resting on the floor. Each projection 2 may have a width of approximately one eighth of an inch to one inch with a spacing of approximately two to eight times the width of the projections between the vertical axes of adjacent projections 2, but constrained so that at least four projections 2 are at least partially in any circle inscribed on the draining surface 3 that is three inches in diameter. A fixed spacing, so a fully regular pattern is formed, and projections of the same size are preferred to simplify the manufacturing of the mats and optimize the use of material.

The spacing of the projections 2 is designed so that when snow is falling on the mat it will fall between the projections 2 on to the draining surface 3 where it will melt and then the resulting water will run across the draining surface 3 to an edge or a water exit 5. Melting of snow may be facilitated by sunlight or by a melting agent, such as salt, that is placed on the draining surface 3. In order to facilitate the operation of the mat when it is snowing, the sum of the cross-sectional area of the projections 2 should be no more than one-quarter of the total area of the draining surface 3, or of the mat, and preferably less than one-eighth of the total area.

The projections 2 also serve to help remove material attached to the bottom of a shoe, such as mud and snow.

Alternatively other shapes of projections 2 may be used, such as conical, frusto-conical, cylindrical, ovoid, hemispherical or polyhedral shapes. The tops of the projections 2 may be flat or alternatively may be rounded, which helps to prevent the accumulation of snow and other particles on top of the projections 2.

The projections 2 may be made of a rigid material or alternatively may be formed from a compressible material that substantially returns to an uncompressed configuration following compression to provide a cushioning effect. The projections 2 may be hollow or solid, or partially hollow, and need not be made solely of a single material. For example, to provide a superior cushioning effect, each projection 2 could comprise a base portion connected directly to the draining surface 3 and a spring portion being the upper portion of the projection 2. The base portion may be a relatively incompressible material and the spring portion relatively compressible. The spring portion may be a hollow truncated cone of a diameter less than that of the base portion and which deflects in the direction of the draining surface 3. For example, the spring portion may be a belleville spring.

Figure 2:
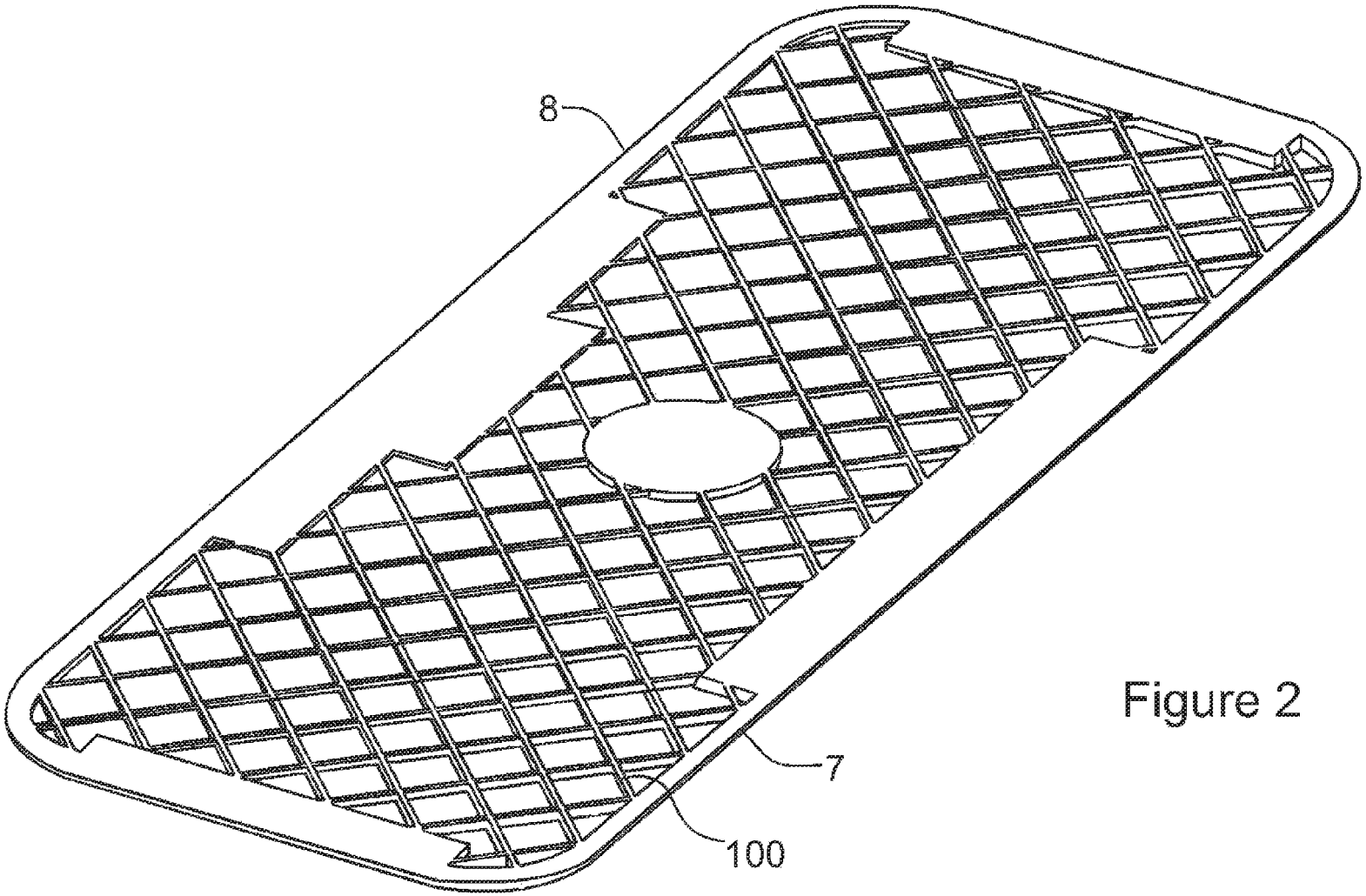
FIG. 2 is a perspective view of one embodiment of the invention showing the lower side.

The underside of the base 1 may be solid and flat, or it may alternatively employ a number of surfaces which lie in a single plane and are distributed across the length and width of the base 1 so that when they are in contact with the floor, the mat rests in a stable position on the floor. FIG. 2 shows the underside of one embodiment of the invention that employs a grid of relatively thin ribs 100. The embodiment shown in FIG. 2, like that shown in FIG. 1, has a front edge 7 that is higher than the back edge 8 with a planar draining surface 3 for directing water towards the back edge 8. In this design, the draining surface 3 is the upper side of a relatively thin layer of approximately uniform thickness with the ribs 100 varying in height so as to achieve a suitable slope for draining water. In the design shown, the ribs 100 decrease in height proportionally to their distance from the front edge 7.

The mat may optionally further include particle retainers. A particle retainer is a modification of the draining surface 3 that is designed to retain solid particles on the draining surface 3. For example, these may be used to slow the removal of salt from the draining surface 3 that has been put on the draining surface 3 to help melt snow. One form of particle retainer shown in FIG. 1 comprises a shallow depression 6 in the draining surface 3. As shown in FIG. 1, the draining surface 3 includes a plurality of particle retainers that are spaced apart from each other. Such depressions 6 may retain some particles as well as some water with dissolved particles which may evaporate and leave the dissolved material in the depression 6. Alternatively, ridges oriented across the path of flowing water on the draining surface 3 may be employed. For example, in a configuration with a planar draining surface 3 sloping from the back edge 7 down to the front edge 8, ridges parallel to the front and back edges could be employed that span the width of the mat.

The foregoing are specific examples of certain aspects of the present invention. Many other embodiments, including modifications and variations thereof, are also possible and will become apparent to those skilled in the art upon a review of the invention as described herein. Accordingly, all suitable modifications, variations and equivalents may be resorted to, and such modifications, variations and equivalents are intended to fall within the scope of the invention as described herein and within the scope of the appended claims.

What is claimed is:

1. A foot mat for resting on a floor and for supporting a person who steps on the mat, the person wearing a shoe having a sole, the mat comprising a. a base having a sloping draining surface for draining water, the base having a front edge, a back edge, a left edge, and a right edge, the draining surface having a total area, the draining surface comprising a plurality of particle retainers for slowing removal of particles on the draining surface, the particle retainers being spaced apart from each other, and b. a plurality of projections, each projection having a top and having a cross-sectional area, the projections having a total cross-sectional area equal to the sum of the cross-sectional area of each projection, the projections being connected to the base for engaging with the sole of the shoe to support the person, wherein the total cross-sectional area of the projections is less than or equal to one quarter of the total area of the draining surface.

2. The foot mat of claim 1 wherein the tops of the projections are in a plane parallel to the floor.

3. The foot mat of claim 1 wherein the draining surface is capable of having circles inscribed thereon, the projections are arranged in a regular pattern and at least four of the projections fall at least partially within any circle that could be inscribed on the draining surface having a diameter of three inches.

4. The foot mat of claim 3 wherein each projection is cylindrical and each projection has the same diameter which is at least one eighth of an inch and less than or equal to one inch.

5. The foot mat of claim 4 wherein each projection is separated from the nearest other projection by a distance of at least twice the diameter of the projections and less than or equal to eight times the diameter of the projections, each projection having a central vertical axis, where the distance between two projections is the distance between the central vertical axes of the two projections.

6. The foot mat of claim 1 wherein the base further comprises a water retaining wall extending partially around the edges of the base and has a first water exit to permit water to run off the mat through the first water exit, the water retaining wall being configured to guide water flowing on the sloping draining surface to the first water exit.

7. The foot mat of claim 1 wherein the base is rectangular.

8. The foot mat of claim 7 wherein the front edge is higher than the back edge and the draining surface is sloped to cause water to run off the back edge.

9. The foot mat of claim 8 wherein the base further comprises a water retaining wall extending partially around the edges of the base and has a single water exit to permit water to run off the mat through the single water exit, the water retaining wall being configured to guide water flowing on the sloping draining surface to the single water exit.

10. The foot mat of claim 9 wherein the single water exit is a gap in the water retaining wall on the back edge.

11. The foot mat of claim 10 wherein the width of the single water exit is greater than or equal to five percent of the width of the front edge and less than or equal to twenty-five percent of the width of the front edge.

12. The foot mat of claim 6 wherein the base further comprises a second water exit and wherein the draining surface is sloped to cause water impinging on a portion of the draining surface to run towards the first water exit and to cause water impinging on the other portions of the draining surface to run towards the second water exit.

13. The foot mat of claim 1 wherein a particle retainer is a depression in the draining surface.

14. The foot mat of claim 1 wherein the total cross-sectional area of the projections is less than or equal to one eighth of the total area of the draining surface.

* * * * *